US011231685B2

(12) United States Patent
Bravo

(10) Patent No.: US 11,231,685 B2
(45) Date of Patent: Jan. 25, 2022

(54) TIME ZONE INDICATOR DEVICE

(71) Applicant: The Swatch Group Research and Development Ltd, Marin (CH)

(72) Inventor: Paulo Bravo, Marin-Epagnier (CH)

(73) Assignee: The Swatch Group Research and Development Ltd, Marin (CH)

( * ) Notice: Subject to any disclaimer, the term of this patent is extended or adjusted under 35 U.S.C. 154(b) by 447 days.

(21) Appl. No.: 16/348,750

(22) PCT Filed: Oct. 16, 2017

(86) PCT No.: PCT/EP2017/076364
§ 371 (c)(1),
(2) Date: May 9, 2019

(87) PCT Pub. No.: WO2018/091214
PCT Pub. Date: May 24, 2018

(65) Prior Publication Data

US 2019/0324400 A1 Oct. 24, 2019

(30) Foreign Application Priority Data

Nov. 16, 2016 (EP) ..... 16199219

(51) Int. Cl.
*G04B 19/28* (2006.01)
*G04B 19/22* (2006.01)
*G04B 19/06* (2006.01)

(52) U.S. Cl.
CPC ..... *G04B 19/223* (2013.01); *G04B 19/06* (2013.01); *G04B 19/283* (2013.01)

(58) Field of Classification Search
CPC .... G04B 19/223; G04B 19/283; G04B 19/06; G04B 37/0427
See application file for complete search history.

(56) References Cited

U.S. PATENT DOCUMENTS 4,347,594 A 8/1982 Tschanz
7,826,311 B2 * 11/2010 Lin ..... G04B 19/223 368/22

(Continued)

FOREIGN PATENT DOCUMENTS

CH 685 584 B5 2/1996
EP 1 703 342 A1 9/2006

(Continued)

OTHER PUBLICATIONS

International Search Report dated Dec. 13, 2017 in PCT/EP2017/076364 filed Oct. 16, 2017.

(Continued)

*Primary Examiner* — Sean Kayes
(74) *Attorney, Agent, or Firm* — Oblon, McClelland, Maier & Neustadt, L.L.P.

(57) ABSTRACT

The invention relates to a timepiece comprising at least an hour indicator, a minute indicator, a movement arranged to drive the hour indicator and the minute indicator, a dial, a crown and an indicator for at least one time zone, housed inside a first case. According to the invention, the first case is rotatable inside a second case about an axis of rotation, so that a rotation of the first case in a clockwise or anticlockwise direction with respect to the second case allows a time zone to be chosen and the time in the selected time zone to be indicated.

8 Claims, 5 Drawing Sheets

(56) References Cited

U.S. PATENT DOCUMENTS

| | | | | |
|---|---|---|---|---|
| 8,256,952 | B2 * | 9/2012 | Loiseau | G04B 37/0427 368/281 |
| 2009/0257323 | A1 * | 10/2009 | Soltani | G04B 37/0427 368/281 |
| 2010/0054088 | A1 | 3/2010 | Lin | |

FOREIGN PATENT DOCUMENTS

| | | | |
|---|---|---|---|
| FR | 2727532 | * | 5/1996 |
| JP | 2007-286049 | A | 11/2007 |
| KR | 20-0218867 | Y1 | 4/2001 |
| KR | 20-0266907 | Y1 | 3/2002 |
| WO | WO 79/01104 | A1 | 12/1979 |

OTHER PUBLICATIONS

Korean Office Action dated Sep. 1, 2020 in Korean Patent Application No. 10-2019-7013999 (with English translation), 10 pages.

* cited by examiner

TIME ZONE INDICATOR DEVICE

FIELD OF THE INVENTION

The invention relates to a timepiece provided with a time zone indicator device for timepieces.

BACKGROUND OF THE INVENTION

Watches indicating the time in one or more different time zones have existed for a long time and generally include complicated mechanisms. Conventionally, these watches have an additional hand for indicating the time in another time zone chosen by the user, which cannot practically be adjusted and/or corrected or set to the time if the watch stops.

CH Patent No 685584 attempts to overcome this problem by proposing a watch including an hour indicator arranged, to make one revolution in twelve hours and to indicate the time under one of the time zones, and a minute indicator arranged to make one revolution in one hour and including a movement directly driving the minute indicator, and a rotating member for indicating at least two time zones and which can be manually driven in rotation. The movement is rotatably mounted inside a case comprising, in mesh between the movement and the time zone indicator member, a first gear train and a second gear train for moving the hour and minute hands when the movement is rotated.

One drawback of this type of watch is that the mechanism is relatively complicated, especially for a mechanical watch. Moreover, such an arrangement substantially increases the thickness of the watch, which is detrimental to the aesthetics of the latter. Finally, such a mechanism appears fragile and the slightest shock could cause it to stop working or damage it.

SUMMARY OF THE INVENTION

It is an object of the invention to overcome the various drawbacks of these known techniques.

More precisely, it is an object of the invention to provide a watch with a time zone display device allowing a simplified and intuitive change between the various time zones.

It is another object of the invention to provide a watch with a time zone display device which is simple and inexpensive to implement.

These objects, in addition to others which will appear more clearly hereinafter, are achieved by the invention by a timepiece comprising at least one hour indicator, a minute indicator, a movement arranged to drive the hour indicator and the minute indicator, a dial, a flange, a crown and an indicator for at least one time zone, housed inside a first case.

According to the invention, the first case is rotatable inside a second case about an axis of rotation coincident with the axis of rotation of the hour and minute indicators, so that a rotation of the first case in a clockwise or anticlockwise direction with respect to the second case allows a time zone to be chosen and the time, in the selected time zone to be indicated.

Thus, through the various functional and structural aspects described above, the object of the present invention makes it possible to obtain a watch with a relatively simple time zone indicator while also providing easy and intuitive adjustment.

In accordance with other advantageous variants of the invention:

- the second case includes an upper part and a lower part joined to each other so as to confine the first case, the upper part or the lower part receiving horns for attachment of a bracelet thereto;
- the first case respectively includes a shoulder on its upper part and its lower part, each shoulder being arranged to cooperate with an aperture formed in the upper part and a lower part of the second case;
- the timepiece includes means for locking the first case relative to the second case;
- the locking, means include at least one spring loaded ball cooperating with a hole;
- the second case includes, on each horn, a countersink for passage of the crown during rotation of the first case with respect to the second case;
- the second case is perforated on its lateral, upper and lower parts, in order to provide access to the crown;
- the time zones are indicated on the back cover of the first case, or on the edge of the first case, or on the flange of the first case;
- the hour indicator and the minute indicator are formed by two distinct, superposed discs, the hour disc carrying a hand for indicating the hour;
- the hour disc is transparent, and, the minute disc is opaque, the minute disc having an aperture for displaying the minutes on the dial.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

A timepiece with a time zone display device according to the invention will now be described below referring jointly to FIGS. 1 to 6.

Figure 1:
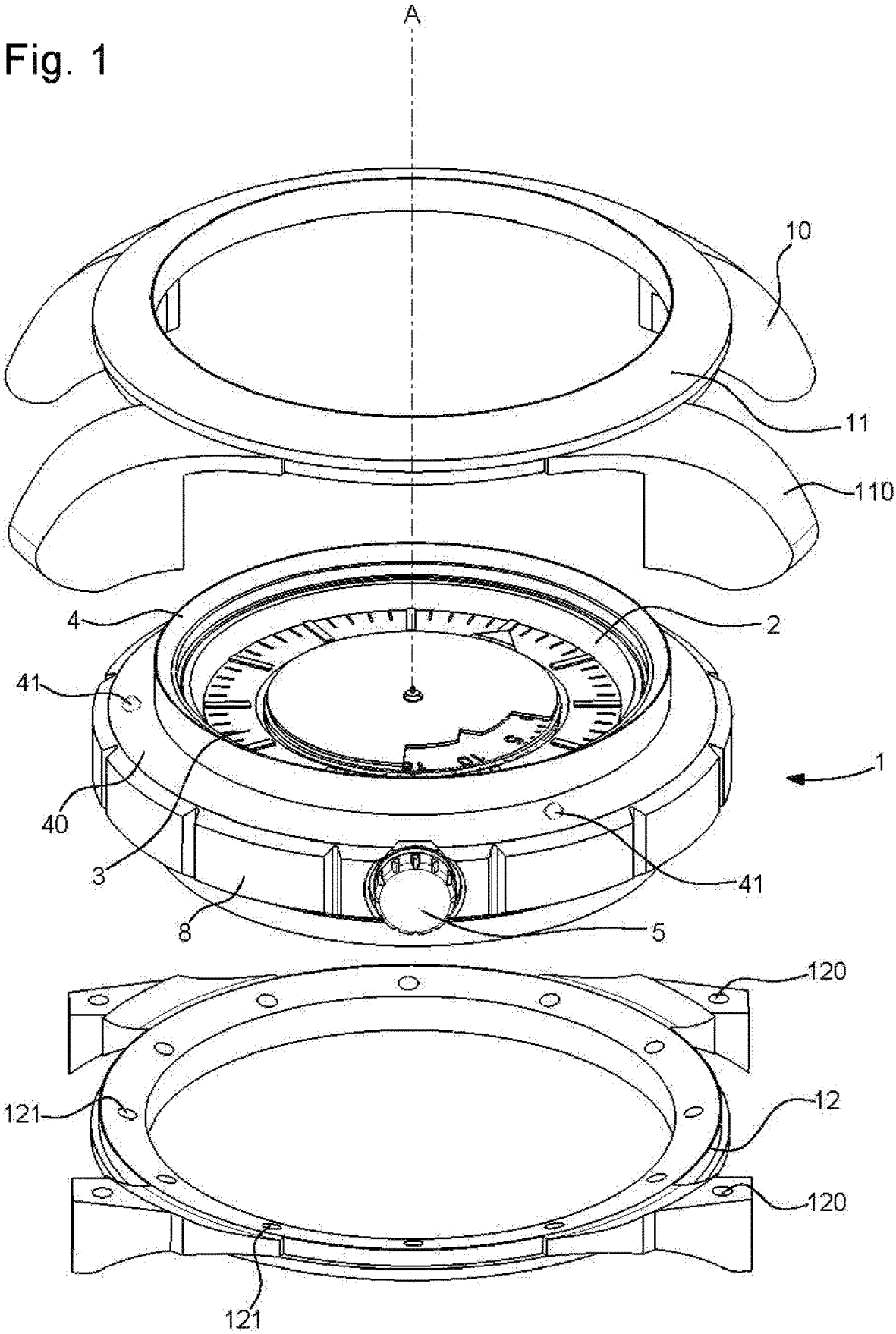
FIG. 1 is an exploded view of a timepiece according to the invention.

As can be observed in FIG. 1, the watch includes an ordinary movement, contained in a first case 1, the case including a dial 3 surrounded and surmounted by a flange 2, a crystal surmounting flange 2, and a collar 4 surrounding the crystal to form a shoulder 40 on the upper edge of first case 1. The encased movement could be a mechanical movement or a quartz movement or an electromechanical movement, the movement being arranged to drive an hour indicator 6 and a minute indicator 7. In the case of a twelve hour display, hour indicator 6 makes one revolution of the dial in twelve hours, and in the case of a twenty-four hour display, hour indicator 6 makes one revolution of the dial in twenty-four hours.

According to the invention, the watch also includes a second case 10 having a lower part 12 screwed onto an upper part 11, the upper part including horns 110 for attachment to a bracelet. According to a particularly advantageous aspect of the invention, first case 1 is rotatably mounted inside second case 10. Evidently, the horns can also be carried by lower part 12 of second case 10.

Figure 2:
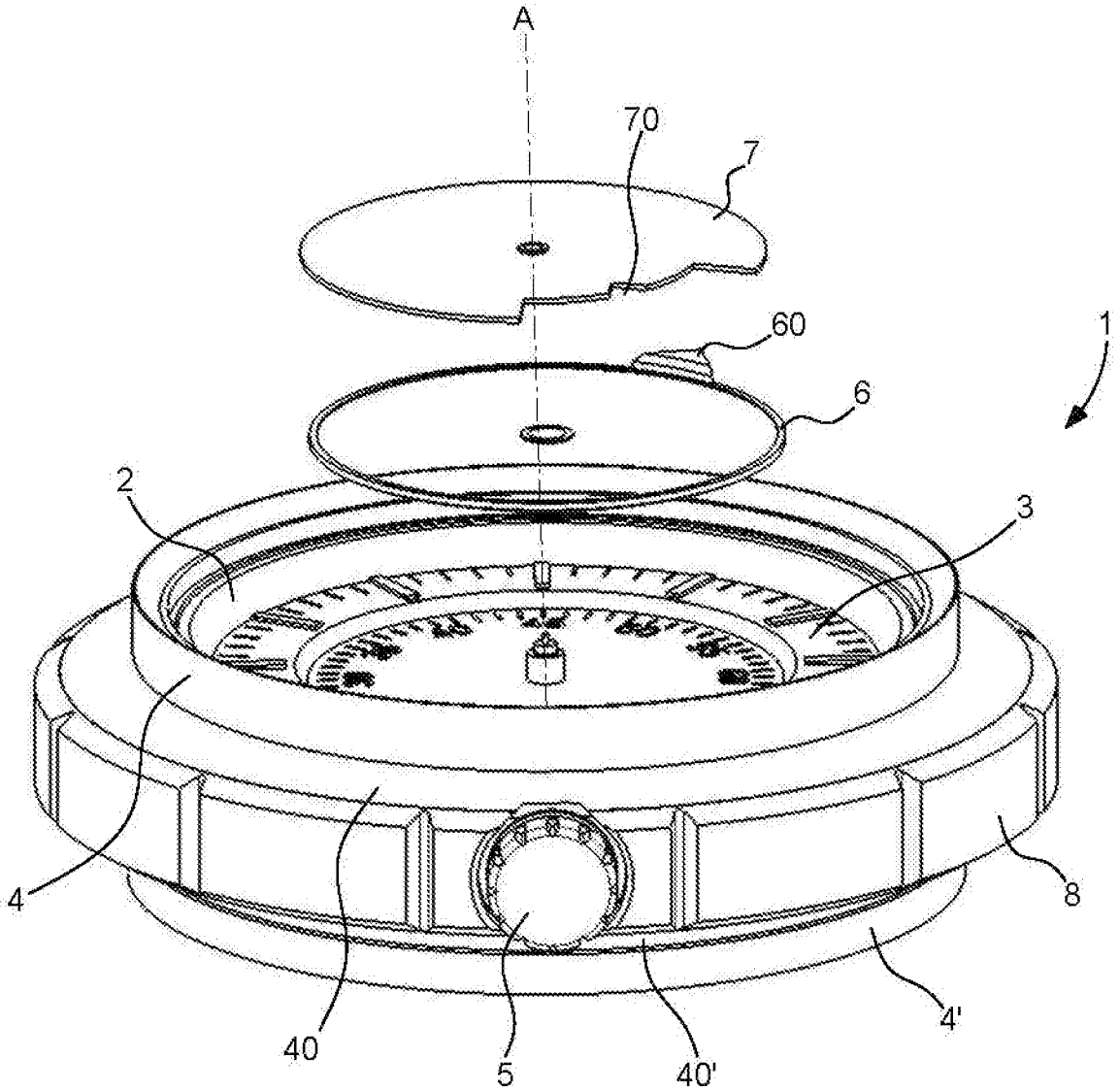
FIG. 2 is an exploded view of the first case of a timepiece according to the invention.

As can be seen in FIG. 2, first case 1 respectively includes on its upper part and on its lower part a collar 4, 4' and a shoulder 40, 40', each assembly forming a peripheral annular rim arranged to cooperate with a circular aperture formed in each of upper part 11 and lower part 12 of second case 10. First case 1 is thus held inside second case 10 so as only to allow rotation of first case 1 about an axis A coincident with the axis of rotation of hour indicator 6 and minute indicator 7.

Figure 3A:
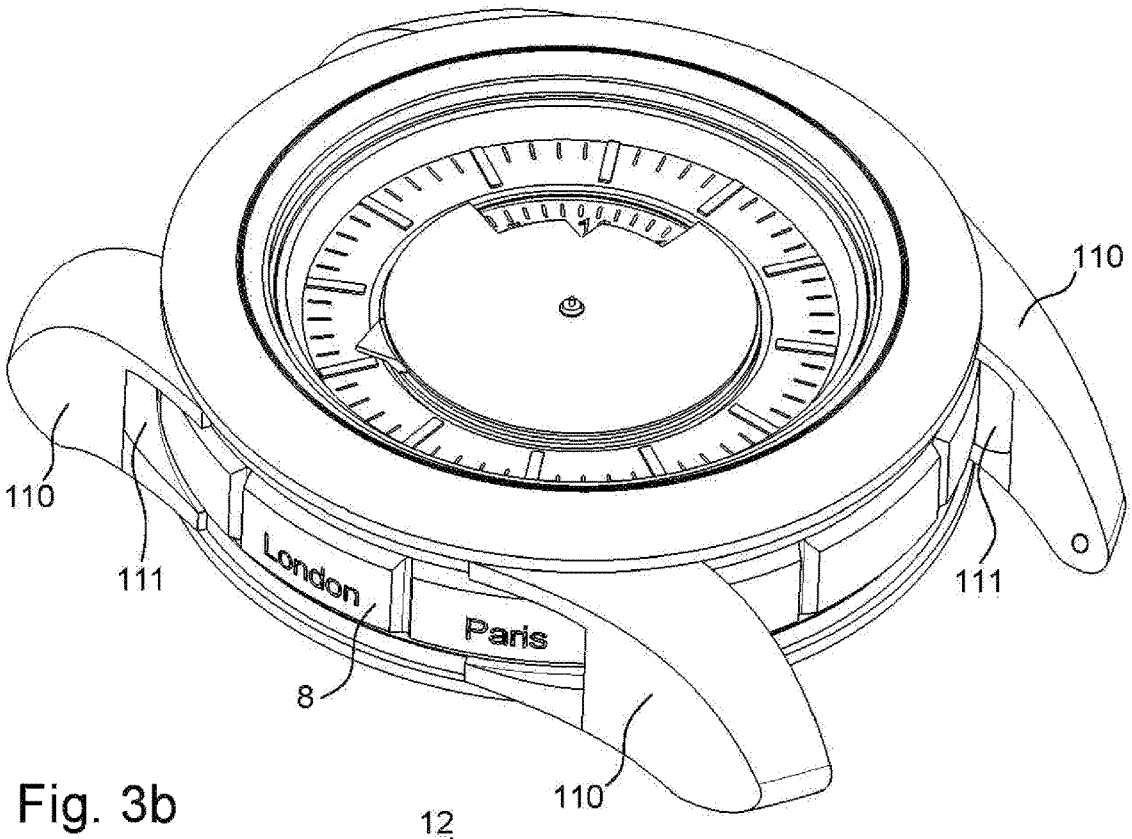
FIGS. 3*a* and 3*b* each illustrate a distinct embodiment for the time zone display.

According to the embodiment illustrated in FIG. 3*a*, first case 1 includes sections 8 on its edge, with each section 8 receiving a time zone. According to another embodiment illustrated in FIG. 3*b*, it is flange 2 that receives the various time zones, which may be twelve or twenty-four in number, for example. According to yet another embodiment seen in FIGS. 4*a* and 5*a*, the time zones are displayed on the back cover of first case 1, the back cover being visible through the lower part of second case 10. In order to improve the use of the watch, each time zone includes a '+' or '-' sign so that the wearer can ascertain whether it is day or night in the selected time zone.

According to the invention, the indicator indicating the time zone must be integral with and rotate with first case 1, the time displayed being that of the time zone at midday on first case 1. Those skilled in the art could add a marker on the fixed part, namely second case 10, to improve readability. Such a marker could, for example, be an inverted triangle, an arrow or a conventional index.

In order to control rotation of first case 1 with respect to second case 10, locking means are provided between first case 1 and second case 10. More precisely, the locking means include at least one spring loaded ball 41 disposed on shoulder 40, 40' of first case 1, this spring loaded ball 41 being arranged to cooperate with hemispheric holes 121 formed along the periphery of the lower and upper parts of second case 10. In the embodiment represented, there are twelve regularly distributed holes 121 spaced apart at 30° so that a rotation from one hole to another corresponds to a time difference of +/−1 hour. In the case where the watch includes a twenty-four hour display, there are of course twenty-four holes 121.

It is also possible to place at least one spring loaded ball 41 on a single shoulder of first case 1, the spring loaded ball cooperating with holes 121 formed on upper part 11 or lower part 12 of second case 10, the part that does not receive the spring loaded ball can then receive a ball bearing or roller bearing.

Figure 6:
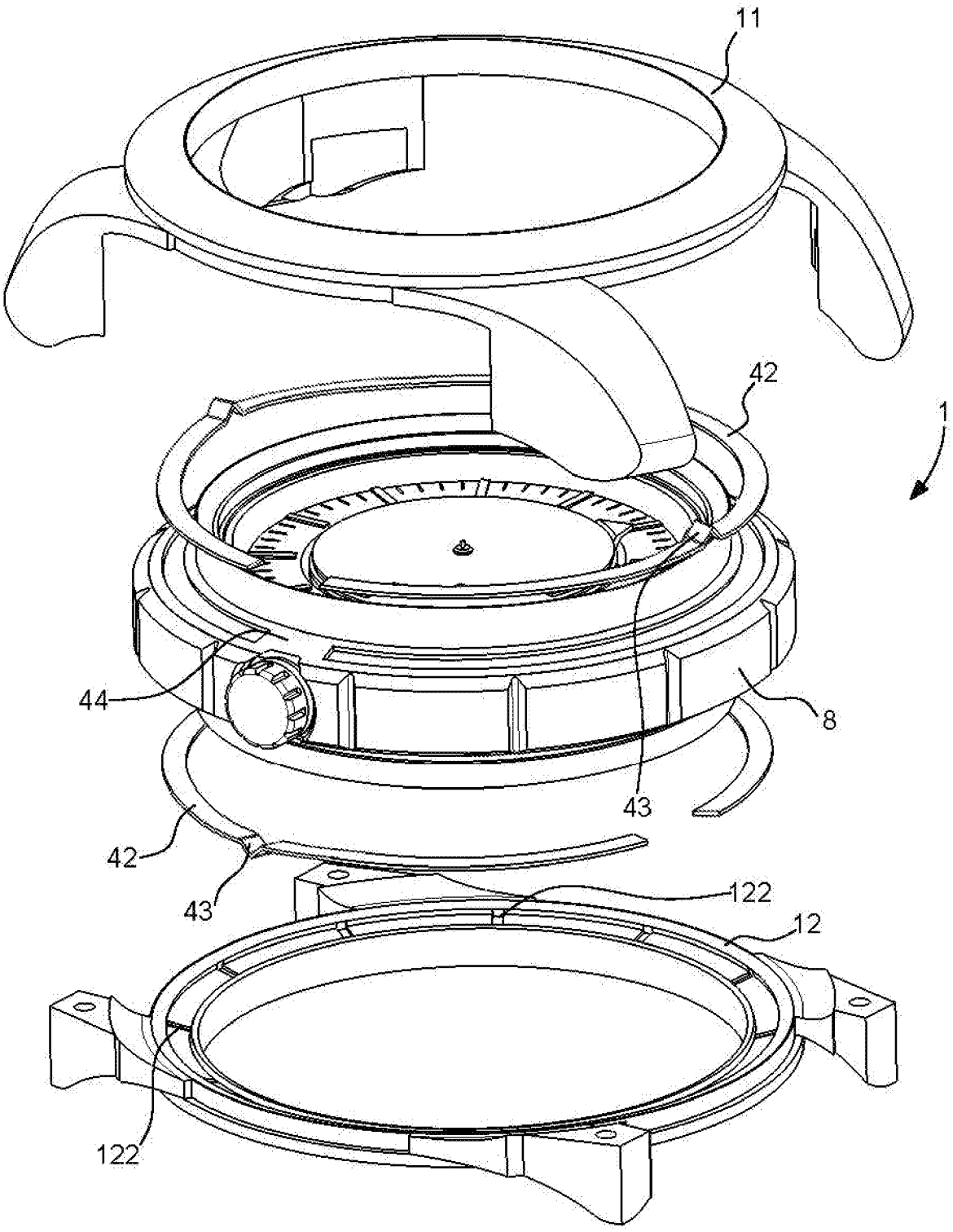
FIG. 6 is an exploded view of the first case of a timepiece according to the invention according to another embodiment.

Those skilled in the art could evidently find other alternatives to the spring loaded ball, such as a strip spring device illustrated in FIG. 6, for example. Such a strip spring device includes a strip spring 42 disposed in grooves formed on shoulders 40 and 40' of first case 1, each groove having a stop member 44 to hold strip spring 42 in place. Advantageously, strip spring 42 includes at least one tooth 43 arranged to cooperate with grooves 122 formed in the upper and lower parts of second case 10.

According to a particularly advantageous aspect of the invention, hour indicator 6 is formed by a transparent disc bearing a triangle 60 indicating the current time on the dial with does not bear any numerals for the hours. Another disc forming minute indicator 7 is mounted on hour disc 6, the minute disc having an aperture 70 revealing the current minutes on the dial, the minutes being on this occasion displayed on dial 3 in a numerical manner. Thus, dial 3 includes two portions, one without numerical indications for the hours, and the other with numerical indications for the minutes. Such a display mode allows case 1 to be rotated without concern as to any discrepancy in minute indicator 7 during a change of time zone.

Thus, to choose to display the time of a specific time zone, first case 1 simply has to be pivoted with respect to second case 10, by manipulating it manually until the time zone is positioned at midday on first case 1. The twelve holes make it possible to pivot the first case hour by hour, regardless of the direction of rotation, in correspondence with the time zones which generally differ by one hour from each other, and the watch then allows the time to be read in the various time zones indicated by the indicator.

Figure 3B:
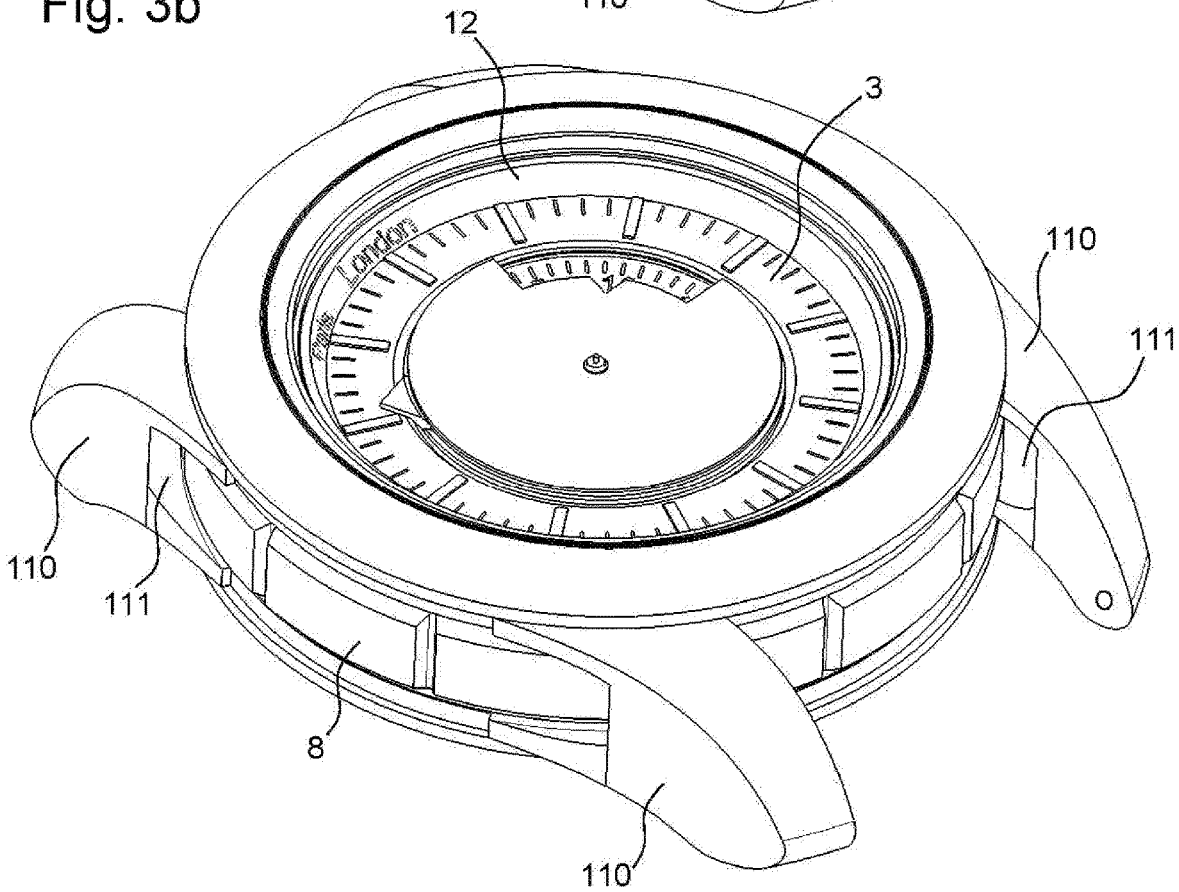

As illustrated in FIGS. 3*a* and 3*b*, second case 10 includes, on each horn 110, a countersink 111 for passage of the crown 5 during rotation of first case 1 with respect to second case 10. Moreover, the second case is perforated on its lateral, upper and lower parts, in order to provide access to crown 5.

Figure 4A:
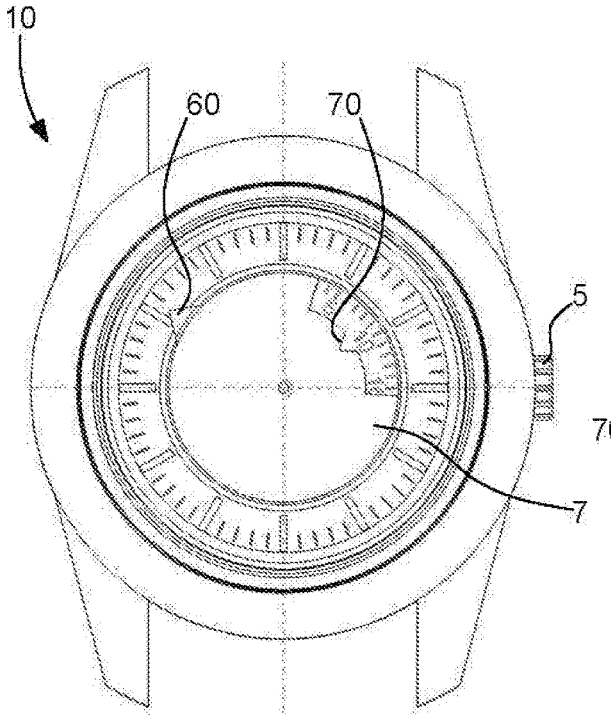
FIGS. 4*a* and 4*b* are respectively a front view and bottom view of a timepiece according to the invention displaying the time in London.
Figure 5A:
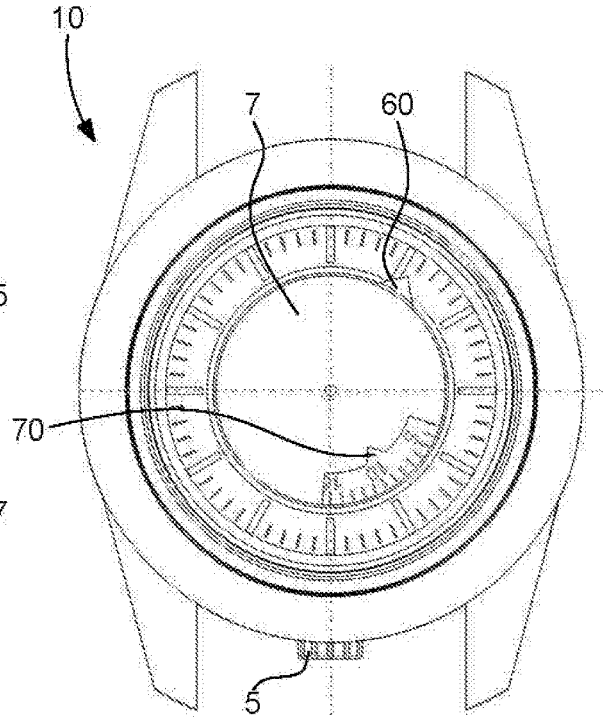
FIGS. 5*a* and 5*b* are respectively a front view and bottom view of a timepiece according to the invention displaying the time in Moscow.
Figure 4B:
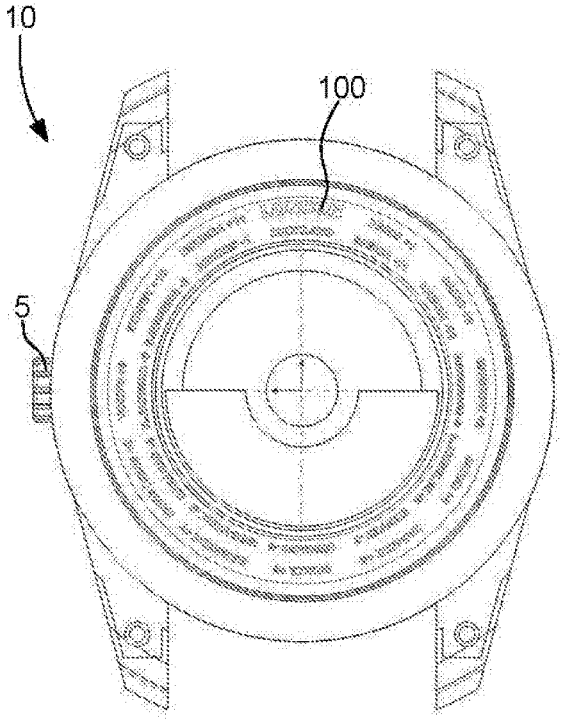
Figure 5B:
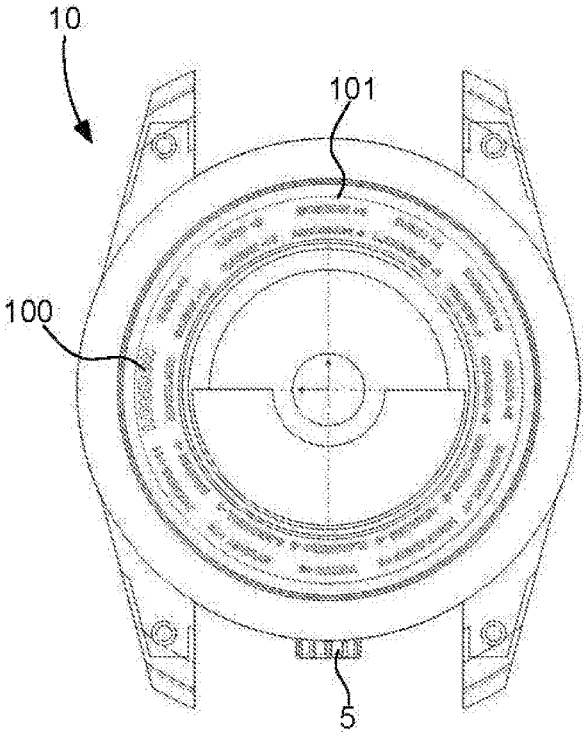

If the wearer of the watch wishes to know the current time in a specific time zone, he need only rotate the first case in a clockwise or anticlockwise direction. For example, in the case where the wearer is in the London time zone 100 as illustrated in FIGS. 4*a* and 4*b*, and wishes to display the current time in Moscow, he need only bring the Moscow time zone indicator 101 to midday on first case 1, which corresponds to three shifts and moves crown 5 by three hours to 6 o'clock. The change of local time from one time zone to another is thus greatly facilitated and simplified by means of this watch.

For any change of time, for example for the change from summer time to winter time or vice versa, the wearer must start at the London time zone position and then choose the time zone to display the time in the selected time zone.

Of course, this invention is not limited to the illustrated example but is capable of different variants and modifications that will appear to those skilled in the art.

The invention claimed is:

1. A timepiece comprising:

at least an hour indicator;

a minute indicator;

a movement arranged to drive the hour indicator and the minute indicator;

a dial;

a crown; and an indicator for at least one time zone, housed inside a first case, wherein the first case is rotatable inside a second case about an axis of rotation of the first case coincident with an axis of rotation of the hour and minute indicators, so that a rotation of the first case in a clockwise or counterclockwise direction with respect to the second case allows a time zone to be chosen and a time in the selected time zone to be indicated, and wherein the second case has a lower part screwed onto an upper part comprising horns, each of the horns of the second case has a countersink for passage of the crown during rotation of the first case inside the second case, and the second case is perforated on lateral, the upper part, and the lower part to provide access to the crown.

2. The timepiece according to claim 1, wherein the first case respectively includes a shoulder on an upper part and a lower part, each shoulder being arranged to cooperate with an aperture formed in the upper and lower part of the second case.

3. The timepiece according to claim 1, further comprising means for locking the first case with respect to the second case.

4. The timepiece according to claim 3, wherein the locking means include at least one spring loaded ball disposed on at least one shoulder of the first case, the spring loaded ball cooperating with at least one hole formed in the upper and/or lower part of the second case.

5. The timepiece according to claim 3, wherein the locking means include a strip spring device comprising a strip spring disposed in a groove formed on at least one shoulder of the first case, the strip spring including at least one tooth arranged to cooperate with grooves formed in the upper and/or lower part of the second case.

6. The timepiece according to claim 1, wherein the time zones are indicated on a back cover of the first case, on an edge of the first case, or on a flange mounted inside the first case.

7. The timepiece according to claim 1, wherein the hour indicator and the minute indicator are formed by two distinct superposed discs, the hour disc carrying a hand for indicating the hour.

8. The timepiece according to claim 7, wherein the hour disc is transparent, and the minute disc is opaque, the minute disc having an aperture for displaying the minutes in a numerical manner on the dial.

* * * * *